US008870109B2

(12) United States Patent
Ghibellini et al.

(10) Patent No.: US 8,870,109 B2
(45) Date of Patent: Oct. 28, 2014

(54) SPARE PART FOR DISC REFINERS FOR THE PRODUCTION OF PAPER

(75) Inventors: Michele Ghibellini, San Giovanni Lupatoto (IT); Luca Ghibellini, San Giovanni Lupatoto (IT)

(73) Assignee: Officine Airaghi S.R.L., Verona (IT)

( * ) Notice: Subject to any disclaimer, the term of this patent is extended or adjusted under 35 U.S.C. 154(b) by 335 days.

(21) Appl. No.: 13/204,576

(22) Filed: Aug. 5, 2011

(65) Prior Publication Data

US 2012/0032010 A1 Feb. 9, 2012

(30) Foreign Application Priority Data

Aug. 6, 2010 (IT) ..... VR2010A0165

(51) Int. Cl.
*B02C 7/04* (2006.01)
*D21D 1/30* (2006.01)

(52) U.S. Cl.
CPC ..... *D21D 1/306* (2013.01)
USPC ..... 241/261.3; 241/296

(58) Field of Classification Search
USPC ..... 241/261.3, 261.2, 296, 298
See application file for complete search history.

(56) References Cited

U.S. PATENT DOCUMENTS 1,098,325 A * 5/1914 Kihlgren ..... 241/146
1,609,717 A * 12/1926 Holland-Letz ..... 241/261.3
1,662,572 A * 3/1928 Fryer ..... 241/261.3
1,795,603 A * 3/1931 Hussey ..... 241/21
2,654,295 A * 10/1953 Sutherland ..... 241/245
4,023,737 A * 5/1977 Leider et al. ..... 241/261.3
4,034,921 A * 7/1977 Schnitzer ..... 241/157
4,039,152 A * 8/1977 Peterson ..... 241/245
4,090,672 A 5/1978 Ahrel
4,166,584 A * 9/1979 Asplund ..... 241/261.3
4,676,440 A * 6/1987 Perkola ..... 241/261.3
4,678,127 A * 7/1987 Cumpston ..... 241/46.04
5,039,022 A * 8/1991 Nilsson ..... 241/261.1
5,042,726 A * 8/1991 Reinhall ..... 241/28
5,335,865 A * 8/1994 Kohler et al. ..... 241/28
5,362,003 A * 11/1994 Virving ..... 241/261.3
5,683,048 A * 11/1997 Virving ..... 241/261.2
5,704,559 A * 1/1998 Froberg et al. ..... 241/261.3
5,747,707 A * 5/1998 Johansson et al. ..... 73/862.623
5,823,453 A * 10/1998 Garasimowicz ..... 241/261.3

(Continued)

FOREIGN PATENT DOCUMENTS

DE 25 35 979 A1 2/1977
DE 102 03 752 C1 9/2003

(Continued)

*Primary Examiner* — Faye Francis
(74) *Attorney, Agent, or Firm* — Greenberg Traurig, LLP

(57) ABSTRACT

A spare part for disc refiners with a stator and/or rotor used in a disc refiner for low consistency pulp and paper refining with a dry fiber residue between 2% and 6%. The stator and/or rotor each comprise a disc-shaped metallic element with a refining blade surface having alternating bars and grooves. The rotor is designed to be driven and rotated around its own axis of rotation which passes through the center of the disc-shaped element so that the rotor bars perform a rotary movement in front of the stator bars with a suitable air gap in between. The blade surfaces or pattern have a pre-set angle greater than 0° with respect to a plane perpendicular to the rotor axis of rotation. This enables advantages in terms of the quantity and the quality of the refined product, and the potential to reduce the energy consumed.

7 Claims, 3 Drawing Sheets

(56) References Cited

U.S. PATENT DOCUMENTS

Figure 1:
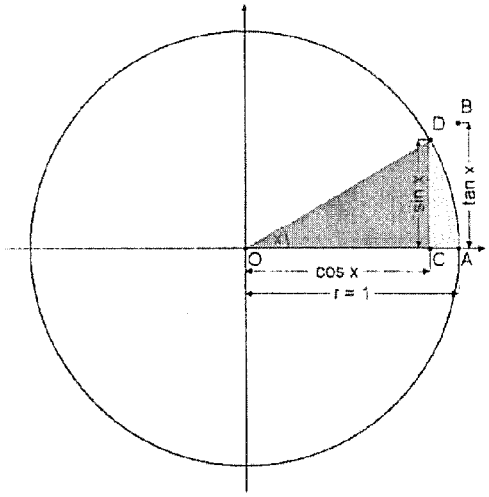

| | | | | |
|---|---|---|---|---|
| 5,971,307 | A * | 10/1999 | Davenport | 241/259.1 |
| 5,975,440 | A * | 11/1999 | Watson | 241/18 |
| 6,032,888 | A * | 3/2000 | Deuchars | 241/261.3 |
| 6,053,440 | A * | 4/2000 | LaRiviere | 241/46.01 |
| 6,276,622 | B1 * | 8/2001 | Obitz | 241/261.3 |
| 6,935,589 | B1 * | 8/2005 | Matthew | 241/298 |
| 7,172,148 | B2 * | 2/2007 | Cassidy | 241/261.3 |
| 7,458,533 | B2 * | 12/2008 | Gingras | 241/261.3 |
| 7,478,773 | B2 * | 1/2009 | Gingras et al. | 241/298 |
| 7,766,269 | B2 * | 8/2010 | Gingras | 241/261.3 |
| 7,779,525 | B2 * | 8/2010 | Matthew | 29/428 |
| 8,342,437 | B2 * | 1/2013 | Antensteiner | 241/261.3 |
| 2007/0029424 | A1 | 2/2007 | Gorton-Hulgerth et al. | |
| 2009/0001204 | A1 * | 1/2009 | Antensteiner | 241/261.3 |
| 2009/0145990 | A1 | 6/2009 | Vuorio | |

FOREIGN PATENT DOCUMENTS

| | | | |
|---|---|---|---|
| EP | 1 749 922 | A1 | 2/2007 |
| WO | WO 2007/048321 | A1 | 5/2007 |
| WO | WO 2007/085703 | A1 | 8/2007 |

* cited by examiner

SPARE PART FOR DISC REFINERS FOR THE PRODUCTION OF PAPER

RELATED APPLICATION

This application claims the benefit of and priority to Italian Patent Application Number VR 2010 A 000165, filed Aug. 6, 2010, the contents of which are incorporated by reference herein in its entirety.

BACKGROUND

1. Field

The present invention refers to a spare part for disc refiners used in the production of paper.

In particular, the present invention refers to a spare part consisting of, respectively, a stator and/or a rotor used in a low consistency disc refiner for the preparation of pulp and paper stock, meaning that it has a dry fibre residue between 2% and 6%. The pulp enters them from one end and exits from other side, passing through a rotating body equipped with blades or an alternation of solids and voids (blades, holes, etc., derived from mechanical processing and made on one face or both) and a shell which has fixed counter-acting blades. Such alternation of solids and voids (bars and grooves) alternation is conventionally defined as "pattern".

The present invention has applications in applied mechanics in the field of paper making and more specifically in the low consistency refining.

2. Background Art

The refining process represents the only phase of the entire paper making process in which the fibres are physically modified. It consists of a mechanical action in which the fibres are processed through two or more consumable bladed fillings (rotors or stators).

The fibrous pulp, which arrives at the refiner in the form of a low consistency aqueous blend (meaning that it generally has a dry fibre residue between 2% and 6%), must pass through the existing spaces between two (or more) opposing spare parts, respectively comprising a rotor and a stator. In this context, the stator is defined as the specific spare part with a fixed, static position inside the refiner, while the rotor is defined as the specific spare part with a mobile position, which when rotating generates a centrifugal effect for the refining the fibrous pulp.

The stator and the rotor in a low consistency disc refiner both comprise substantially discoid metallic elements which each have a blade refining surface with an alternation of blades (bars) and grooves, all of which have the same height (blades) and depth (grooves).

The rotor, being the part which generates the motion, is normally driven around its own axis of rotation in such a way that the blades of the rotor perform a rotary movement in front of the blades of the stator with the interposition of an appropriate air gap of constant height on all of the opposing surfaces of the discs.

In this passage between the blades of the rotor and the stator, the fibres are subject to high levels of compression, friction and cutting, which determine major (and unique) modifications to their physical structure.

The refining action causes modifications to the fibres of a physical nature which can appear more or less intense in measure depending on the conditions adopted for the treatment. Such modifications may be briefly summarized as:

a) Swelling and hydration;

b) Increases in plasticity and flexibility;

c) External fibrillation;

d) Internal fibrillation;

e) Cutting and shortening of the fibres;

f) Formation of fine particles.

Modern refiners for processing low consistency fibrous pulp (meaning that it generally has a dry fibre residue between 2% and 6%) may be classified in 2 principle classes: conical and disc.

The rotor and the stator have on one side a "pattern", alternately consisting of blades (or bars) and crevices (or grooves).

The width, the length and the inclination of the bars (or blades) and the width and depth of the empty spaces (or grooves) constitute the configuration of the spare parts upon which the performance of the refiner depends.

On conical refiners, the principal characteristic is the angle of the cone.

The first conical refiners had a narrow angle: they are in fact assembled with a cone which forms an approximately 10° angle with respect to the axis of rotation, with spare parts which have quite large bars and for this reason they are considered strong action cutting refiners.

Despite this, if used with spare parts with thinner bars, they give optimal results with all types of fibres.

The difficulty of the substitution of spare parts has resulted in the substitution of these refiners with those which are more functional having a medium angle, described below.

Another type of conical refiner is the so called large angle refiner, the structure of which is similar to that with a narrow angle but is assembled with spare parts with an approximate 30° angle with respect to the axis of rotation.

The most recent versions and those which are more widely used for low consistency pulps (meaning a pulp with a dry residue between 2% and 6%) are medium angle refiners which are characterized by cones which form an approximate 20° angle with the axis of rotation and, above all, mechanics which permit easy access to the zone of the fillings therefore reducing maintenance times.

The principal parts which constitute a conical refiner are:

1. a shell with a pulp entry and exit;
2. a conical rotor;
3. a conical stator;
4. a regulation mechanism of the rotor.

The conical spare parts are used to limit axial forces.

In fact, the effective forces in play during this type of refining action are divided into one which is axial (parallel) and one which is perpendicular to the refining surface.

In terms of disc refiners, the principle of the latter is similar to that which governs the conical refiners.

The pulp which has to be refined in this case is fed centrally to the area between the discs and, due to the centrifugal force produced by the rotation of the rotor disc, the pulp tends to move toward the periphery, undergoing the rubbing action between the bars of the stator discs (fixed) and the bars of the rotor discs (mobile).

Given their high peripheral speed these machines usually guarantee optimal production.

Taking into account the disc fillings, this type of refiner is distinguished for its very compact structure.

However, the loss of energy for pumping power (no load) is higher in comparison with other machines.

Normally, it seeks to limit this loss by using shallow grooves.

Disc refiners have three basic layouts depending on the type of spare part used:

refiners with a fixed disc and a rotating disc;

refiners with two rotating discs and two fixed discs;

multi-disc refiners (with more than two rotor-stator pairs).

Disc refiners can be further divided depending on the direction of the flow of pulp inside the refiners themselves.

In terms of the quality of the refining, it is recognized that a substantial difference exists between a refining action with discoid spare parts and refining with conical ones.

In fact, due to the type of flow found between the rotor and the stator, and also due to the vortices and the centrifugal forces generated, not all of the fibres treated in the disc refiner can be refined; some can, in fact, follow the cavities of the plate from the entry to the exit.

In fact, it has been demonstrated that, in some cases, a considerable number of fibres are not refined in the first passage through the disc refiner.

As a consequence, the refining efficiency and the energy efficiency are relatively low.

In a disc refiner, therefore, it is probable that the fibres which come into contact with the blades tend to be over-refined to compensate for those which have not been refined in a way which achieves the desired pulp freeness (° SR—Shopper Riegler).

This causes an excessive formation of fines, a weakening of the refined fibres and energy inefficiency applied to the fibre.

This all happens on a much smaller scale in the conical spare part, because the hydrodynamic forces in play tend to push the fibres from the rotor towards the stator, creating a sort of thrust and successive slippage of the pulp which avoids the immediate outflow from the spare parts of the latter, therefore retaining the majority of the pulp.

In fact, the centrifugal force and the flows of the vortices on the inside of the conical refiner create and facilitate the passage of the fibres from the grooves toward the bars.

This creates, therefore, a type of spiral movement around the piece, as opposed to what happens with the discs, given that the pulp is rapidly pumped toward the exterior.

The conical refiner, therefore, permits an improvement in processing, a more complete and uniform treatment of the fibres and an improvement in energy efficiency which is also due to the fact that the fibres are in contact with the bar for a longer time.

In the refining process itself the fibres are not refined individually but in flakes.

In the range of fibrous pulp with a consistency between 2% and 6%, where the low consistency refining is located, the fibres are not free to move independently.

Inside the fibrous suspension, a non-homogenous structure composed of fibres is created which, being close to one another, interact between themselves and generate flakes; such flakes form and break up continually under the effect of the different intensities of the cutting forces which exist in the grooves and in the refining zone.

The size and the thickness of the flakes (1-5 mm) are much larger compared to the distance which is found between the bars of the stator and the rotor in the refining phase (usually even less than a few tenths of a millimeter.)

For this reason, the probability that the flakes in this form can be driven between the edges of the blades of the rotor and the stator is not very high. To promote the effects of the refining (external fibrillation, delamination of the internal structure of the wall, cutting of the fibres, etc.) the operative energy is transferred from the refiner to the pulp in the following three modes:

in the moment in which the flake is caught between the edges of the two bars, of the stator and of the rotor, and the fibres are subject to cutting actions;

when the bars are overlapped and part of the flake is found between the edge of the tooth of the rotor and the surface of the stator and then between the two surfaces; in this phase the elastic flakes of the fibre are compressed between the blades with a dynamic filtration of the water from the fibres;

with the continuous fibre-fibre friction action, inside the flakes, in the flow of the pulp which passes through the cavities.

During the design stage of the rotors and stators of the refiners, the dimensions of the bars and grooves (pattern) and the angle of the same pattern itself determine the "cutting edge length" [L].

This length is measured in meters or kilometers.

The cutting edge length L represents, therefore, the total length of the "contact" between the rotor and stator blades at each turn of the rotor and is expressed as follows:

$$(DR \times nB^2) \times ni/\cos \alpha [L]$$

where:

DR=radial increment of the teeth (m);

nB=number of blades for each radial increment (number of teeth/sector×number of sectors);

ni=number of interfaces (for 4 discs, ni=2);

$\alpha$=average angle between teeth and the radius of the tip of the same tooth.

Refining processes involve the use of considerable amounts of energy. In effect, refining accounts for 25-30% of the total requirement of electric energy in paper making and is therefore an important factor.

The energy consumed during the refining process is therefore a major factor influencing the results of the refining.

With the machines in use today, it is not possible to transmit all of the energy which is produced to the refining of the pulp, and a part of the energy is dissipated in the form of friction and heating of the fibrous suspension.

In order to determine the efficiency of the refining process with sufficient precision, it is important to know the real no-load power of the refiner used.

The power required to rotate freely, which is subtracted from the current consumption in the refining phase, is the sum of the electric losses of the motor, of the mechanical losses, due to friction in the motor and in the refiner, and of the hydraulic or circulating power, which is the quantity of energy absorbed by the hydraulic action due to the effect of turbulence or pumping.

The no-load power depends mainly on the diameter and rotary speed of the rotor part, but it can also be significantly affected by the configuration of the bars and grooves (i.e. by the pattern).

Factors like flow, consistency of the pulp and air gap (meaning the existing distance between the stator disc and rotor disc) have a relatively minor importance.

The effective power applied, therefore, which determines the changes of the properties of the pulp, is constituted by the power consumption in the refining phase from which the no-load power must be subtracted.

For these reasons it is important to know the no-load power consumed by a refiner with its spare parts, and, moreover, it is important to take into account the effective wear of the spare parts.

No-load power can be determined through empirical measurements or calculated according to theoretical formulas.

The factor to be noted, however, is that for each piece of machinery with a spare part, the no-load power NL (no-load) can vary considerably in time, which means that it has a high value when the spare parts are new and a lower value when they are worn down.

Given that it is quite complex to obtain accurate measurements, it is often easier to trust in calculations of values through universally recognized formulas, such as the following:

$$NL=KD^4N^{2.57}$$

the no-load power NL is expressed in kW;

K is a constant which varies between conical and discoid refiners;

D is the diameter of the part expressed in meters;

N is the number of repetitions per second.

This formula shows how the diameter of the disc is a decisive variable in the determination of the no-load power consumption.

In practice, however, the experimental formula generally used for the determination of the dissipated no-load power is the following:

$$NL=(3.083\times10^{-13})D^{4.249}N^3$$

where:

NL is expressed in HP;

the constant K is indicated as $3.083\times10^{-13}$;

D is the diameter of the part expressed in inches;

N is the number of repetitions per minute.

Document WO 2007/085703 describes a refiner comprising a stator and a rotor that comprise a planar portion and a conical portion after the planar portion, which in turn comprise refining surfaces provided with blade bars and blade grooves there between, and the planar portions of the refining surfaces of the stator and the rotor comprising at least two refining zones in the direction of the radius of the planar portion.

The refiner described in this document represents a typical example of an high consistency pulp refiner, meaning that the pulp has a dry residue which is not lower than 22%, in which the pulp is fed through a worm screw feeder. The discs of the high density pulp refiners typically have blades and grooves which consist of an inclination (taper) which forms a funnel entry between the stator and the rotor in order to direct the high consistency pulp between the blades and the grooves of the stator and rotor.

On the other hand, the patterns of the stator and rotor disc in low consistency refiners (dry residue between 2% and 6%) are always parallel to each other in order to improve the refining of the cellulose and the distance between the rotor and the stator is therefore constant on all the surfaces of the opposing discs.

The patent documents DE 10203752 C1, EP 1749922 A1, DE 2535979 A1 and WO 2007/048321 also describe high consistency refiners, as shown by the typical worm screw feeder illustrated in the respective drawings attached to those documents. Consequently, in these cases the patterns of the rotor and stator are also not parallel on all the surfaces of the disc and present infeeds to improve the high consistency pulp feed.

None of these documents addresses the problem of supplying a spare part which increases the cutting edge length and enhances the efficiency of the refining procedure, or to supply a spare part, which, for the same cutting edge length, enables the use of discs with smaller diameters with respect to those traditionally used, which would allow one to achieve consistent economies in terms of the energy consumed by the refiner.

DRAWINGS

Figure 3A:
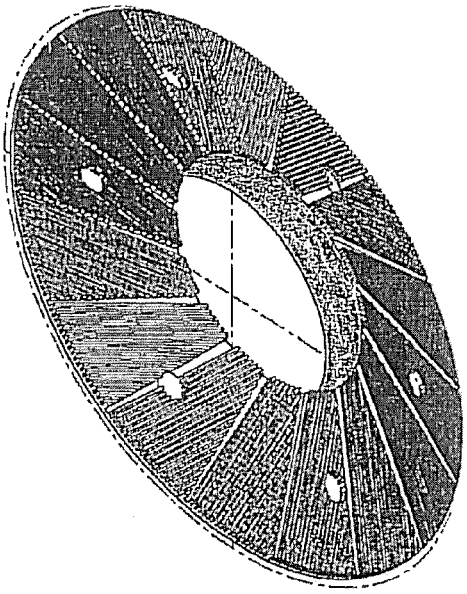
Figure 3B:
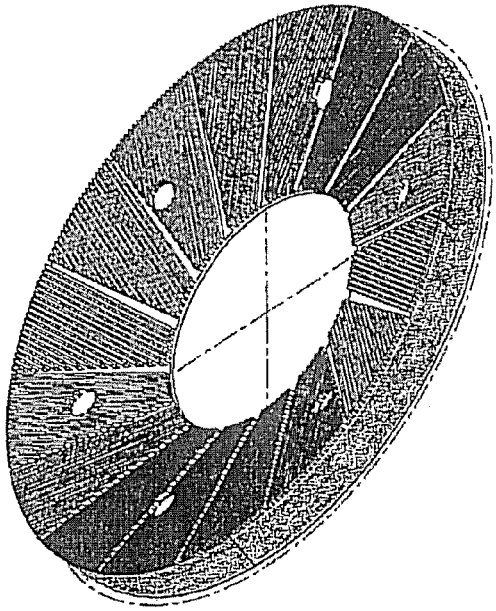
Figure 2F:
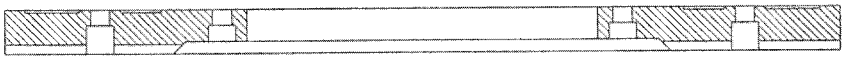
Figure 2E:
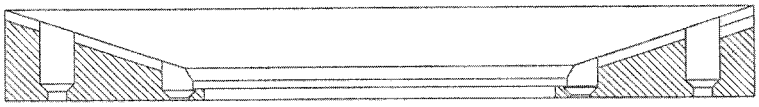
Figure 4:
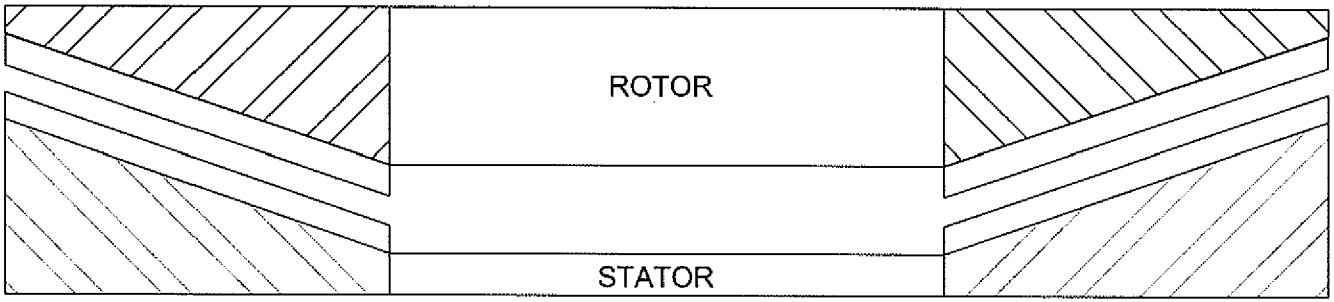

Further features and advantages of the invention will become apparent from the following description of some embodiments of the invention with reference to the annexed drawings, given purely by way of a non-limiting example, in which:

FIG. 1 shows a Cartesian diagram which shows the advantages of using a refining disc equipped with inclined pattern surfaces according to the present invention;

FIGS. 2*a*, 2*b*, 2*c*, 2*d* and 2*e* show side view cross sections of five embodiments of the spare parts, in particular the refining discs, having inclined, rectilinear profiles (FIG. 2*e*) and curves or mixtilinear profiles (FIG. 2*a*, 2*b*, 2*c*, 2*d*) according to the present invention;

FIG. 2*f* shows a side cross section of a known refining disc, therefore at a perpendicular profile to the axis of the disc itself; and FIGS. 3*a* and 3*b* are perspective drawings showing a disc in the form of a rotor and one in the form of a stator according to the present invention, with inclined rectilinear profiles, which are usable as spare parts for a disc refiner for the refining of paper;

FIG. 4 is a cross section of a stator and a rotor according to the invention facing each other, where it is clear that the respective blades (or patterns) are parallel to each other.

DESCRIPTION OF THE INVENTION

The present invention provides new spare parts for disc refiners for the refining of low consistency fibre pulp, meaning that its has a dry residue between 2% and 6%, composed of at least one rotor and at least one stator which, thanks to the special configuration of the blade surface, and without any modification to the existing structure of the refiner, simultaneously permits the following:

improved refining;

substantial energy savings.

This is achieved through a spare part (stator/rotor) for disc refiners for the refining of low consistency fibre pulp, meaning that it has a dry residue between 2% and 6%, having the characteristics described in the main claim.

The dependent claims outline particularly advantageous embodiments of the spare parts described above.

According to a particularly advantageous embodiment of the invention, and in strong contrast with the configurations present in spare parts for disc refiners of the known type—in which the respective blade surfaces of the rotor and of the stator are situated on planes perpendicular to the axis of rotation of the rotor—the spare parts for disc refiners according to the present invention have blade surfaces which have a preset angle with respect to the planes which are perpendicular to the axis of rotation of the rotor.

In a further particularly advantageous embodiment of the invention, and also in stark contrast with the present configurations of the spare parts for disc refiners of the known type, the spare parts for disc refiners according to the present invention have blade surfaces with a generally curvilinear or irregular profile, though always parallel to each other.

The embodiments described above allow one to obtain, alternatively or synergistically:

a considerable increase in the cutting edge length L, that increases the efficiency of the refining action of the disc refiner and, at the same time, allows one to increase the production of a given refiner as though it were equipped with discs with larger diameters—yet without requiring the substitution of the entire refiner with one of a larger size; or the possibility to use, at the same cutting edge length, discs with smaller diameters for the same refiner, which implies considerable energy savings; or to improve the refining action of any disc refiner for the refinement of low consistency fibre pulp, meaning that it has a dry residue between 2% and 6%, given that the configuration according to the invention makes it more difficult for the pulp to exit and, holding it inside the fillings (rotor/stator) for a longer time, the latter is treated in an improved and more uniform way.

In any case, as previously mentioned, it is necessary to emphasise how the spare parts are configured to be inserted into existing disc refiners for the refining of low consistency fibre pulp (meaning that it has a dry residue between 2% and 6%) according to the present invention, without any further conversion or special maintenance of the refiner other than the substitution of the worn discs. This is because the coupling of spare parts according to the present invention have the same thickness as the fillings they are designed to substitute.

DESCRIPTION OF EMBODIMENTS OF THE INVENTION

In FIG. 1, a Cartesian diagram with nonessential errors shows how, at an equivalent cutting edge length, it would be possible to obtain a smaller disc diameter acting on the angle of inclination (x) of the pattern with respect to a pattern which is flat and perpendicular to the axis of the disc itself.

Using the known mathematical formula, $$\cos(x) = \frac{\overline{OC}}{\overline{OD}}$$

and keeping as a constant the cutting edge length, it is possible to derive the angle x of inclination of the pattern corresponding to a given cutting edge length, which corresponds to a predetermined diameter.

By decreasing the diameter of the disc, at the same cutting edge length, it is possible to determine a consistent conservation in terms of dissipated electric energy in no-load conditions. Clearly, a greater inclination of the pattern corresponds to a smaller disc diameter, but one must take into account a constraint in terms of the machine stroke, which obviously cannot exceed the dimensions provided in the refiner.

It should be noted that by using the same formula, and keeping the diameter of the disc constant in this case, it is also possible to understand how it would be possible to obtain greater cutting edge lengths, with respect to traditional disc types, with a spare part with an inclined pattern according to this invention.

This opens up very interesting opportunities from both a manufacturing and commercial point of view. In fact, with the same disc diameters, a given refiner equipped with spare parts according to the present invention could supply better performance in terms of both the quantity of and the quality of refined products, thereby obviating the need to substitute the refiner with one of a larger size when it is necessary to increase production.

The FIGS. 2*a* to 2*e* show some examples of practical embodiments of the spare parts for disc refiners which are obtainable according to the present invention.

Figure 2D:
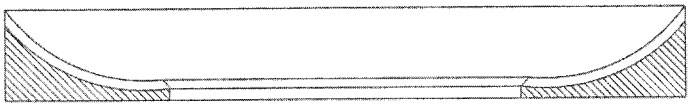
Figure 2C:
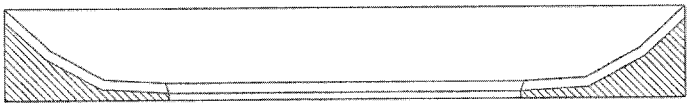
Figure 2B:
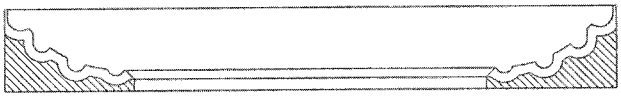
Figure 2A:
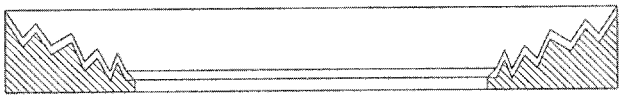

It is worth comparing these figures with FIG. 2*f*, which shows in a traditional disc type, with a 26-inch (66.04 cm) diameter for example. In particular:

the disc illustrated in FIG. 2*a* has, for example, a 24-inch (60.96 cm) diameter and a rectilinear pattern with a uniform inclination angle (as do the discs shown in FIGS. 3*a* and 3*b*);

the disc shown in FIG. 2*d* has, for example, a 22-inch (55.88 cm) diameter and a uniformly curved pattern profile;

the disc illustrated in FIG. 2*c* has, for example, a 22-inch (55.88 cm) diameter and a pattern profile composed of differentially inclined rectilinear segments;

the disc shown in FIG. 2*b* has, for example, a 20-inch (50.80 cm) diameter and a pattern profile comprising both curved and rectilinear elements; and the disc shown in FIG. 2*a* has, for example, a 20-inch (50.80 cm) diameter and a substantially saw-toothed pattern profile.

Clearly, the profile shapes and the diameters of the discs indicated above are example embodiments of the invention which can be applied to any typology of refining discs for the low consistency fibre pulp, meaning that it has a dry residue between 2% and 6%; the diameter and shape of the discs can be freely adapted to particular design needs to take into account the quantity and quality of the product to be refined.

The spare parts according to the present invention can be manufactured using various methods and technologies in accordance with design requirements.

The invention as described above refers to its preferred embodiments.

Naturally, while the principle of the invention remains the same, the details of construction and the embodiments may widely vary with respect to what has been described and illustrated purely by way of the example, without departing from the scope of the present invention.

The invention claimed is:

1. A method of operating a disc refiner for refining a low consistency paper pulp, comprising the steps of using a disc refiner, providing a pair of refining discs for the refiner, said pair of refining discs being a stator and a rotor, both the stator and the rotor including a disc-shaped metallic element with a refining surface having alternating bars and grooves, wherein the stator and the rotor surfaces are always parallel to each other, and having a pre-set inclination angle greater than 0° in respect of a plane perpendicular to the rotor axis of rotation, wherein all the bars of the stator and the rotor surfaces having the same height and all the grooves of stator and the rotor surfaces having the same depth and the opposed surfaces of both the stator and the rotor have inclined profiles in cross section, the method further including the steps of driving the rotor to rotate around its own axis of rotation, passing the axis through the center of the disc refiner, performing a rotary movement with the rotor bars in front of the stator bars with a gap in between, providing said gap with a constant height over the whole surfaces of the opposed discs, and wherein the fibers are not refined individually but in flakes with consistency between 2% and 6% where low density refinement is located and fibers are not free to move independently.

2. The method according to claim 1, in which the blade surfaces or pattern seen in a side cross section includes at least one of a rectilinear or curvilinear profile.

3. The method according to claim 2, in which the side cross section profile is uniformly rectilinear and has a constant angle.

4. The method according to claim 2, in which the side cross section profile comprises a curved line.

5. The method according to claim 2, in which the side cross section profile comprises rectilinear segments angled differently.

6. The method according to claim 2, in which the side cross section profile comprises an assembly of rectilinear and curved elements.

7. The method according to claim 2, in which the side cross section profile substantially has a saw-tooth shape.

* * * * *